United States Patent [19]

Wendt

[11] 4,031,664

[45] June 28, 1977

[54] SUSPENSION SYSTEM FOR SOUND ABSORPTION PANELS

[75] Inventor: Alan C. Wendt, Barrington, Ill.

[73] Assignee: United States Gypsum Company, Chicago, Ill.

[22] Filed: Jan. 20, 1976

[21] Appl. No.: 650,632

[52] U.S. Cl. ..... 49/409; 248/300

[51] Int. Cl.[2] ..... E05D 13/02

[58] Field of Search ..... 49/409–412, 49/404, 405; 160/181, 196, 201; 52/713, 714, 582, 489; 248/300, DIG. 6; 181/30, 33 G; 16/87 R, 90; 206/497

[56] References Cited

UNITED STATES PATENTS

| | | | |
|---|---|---|---|
| 1,260,858 | 3/1918 | Beeman | 160/196 |
| 1,521,045 | 12/1924 | Poyas | 160/201 |
| 1,556,281 | 10/1925 | Bohnet | 160/196 |
| 2,916,159 | 12/1959 | O'Neill | 248/300 |
| 3,140,564 | 7/1964 | Chapman | 181/30 |
| 3,174,590 | 3/1965 | Haker | 52/489 |
| 3,374,882 | 3/1968 | Amaliksen | 206/497 |
| 3,713,508 | 1/1973 | Eckel | 181/33 G |

FOREIGN PATENTS OR APPLICATIONS

| | | | |
|---|---|---|---|
| 651,842 | 11/1962 | Canada | 248/DIG. 6 |

*Primary Examiner*—Peter M. Caun

*Attorney, Agent, or Firm*—Donnie Rudd; Kenneth E. Roberts; Samuel Kurlandsky

[57] ABSTRACT

A hanger is disclosed for supporting sound absorption panels wherein the panels have a top frame member with a depending lip portion. The hanger has a horizontal portion and a vertically downwardly depending portion, with the vertically downwardly depending portion having an upwardly and inwardly formed portion which can engage the depending lip of the frame of the panel to support the panel while the horizontal portion of the hanger is attached to supporting means. The formed portions can be useful in holding together abutting panels.

A horizontally movable sound absorption wall is disclosed having one or more sound absorption panels supported by a top frame member, a hanger attached to the top frame member, and a track and guiding means for guiding the hanger along the track.

13 Claims, 15 Drawing Figures

SUSPENSION SYSTEM FOR SOUND ABSORPTION PANELS

BACKGROUND OF THE INVENTION

1. Field of the Invention

This invention relates to a hanger for supporting sound absorbing panels and a horizontally moving sound absorbtion wall made possible by use of the hanger.

2. Description of the Prior Art

In recent years, industry has become increasingly aware of noise pollution, and, consequently, there has developed the need for effective sound absorption systems. In the past, such sound absorption systems have generally been sound absorption panels attached to a supporting structure such as a wall. In many applications, however, sound absorption is required in the middle of an already constructed room, in order to isolate a sound source, but there is an additional requirement that the sound absorption system be movable in order the continuation of an established flow of goods or traffic that had developed prior to the recognition of the need to isolate the sound emitted from the sound source. In the past, the only two methods useful for accomplishing this goal were to construct a new wall and use conventional sound absorbing panels, or else use some type of drapery material, depending from the ceiling of the building. Construction of a new wall is expensive, and the use of the mere drape provides many disadvantages in lack of sound absorption qualities and in cost and lack of strength of the material when it is required to span large vertical distances.

Prior to this time, there has not been developed an efficient sound absorption system which has all of the advantages of prior sound absorption panels but which is readily relocatable to meet the industrial needs. The new and novel system provided by this invention is the first known system to fulfill all of the needs of the industry.

SUMMARY OF THE INVENTION

It is an object of this invention to provide a complete sound absorption system.

It is the further object of this invention to provide means for supporting sound absorption panels.

It is a further object of this invention to provide a sound absorption system which has all of the advantages of prior systems but which has the additional advantage of being relocatable as required.

The objects of this invention are accomplished by a hanger for supporting sound absorbing panels wherein the panels have a top frame member with a depending lip portion. The hanger has a horizontal portion and a vertically depending portion with the depending portion having an upwardly and inwardly formed portion for engaging the lip on the panel to support the panel while the horizontal portion of the hanger is attached to a supporting structure. The hanger may have two upturned portions on opposing edges spaced apart a distance only slightly greater than vertical frame members within the panel in order that it may engage abutting panels and hold the panel together to form a continuous wall while it also supports the panels. Likewise, the hanger may have two vertically depending portions on opposing edges of the horizontal portion to enable it to engage both sides of the top of the frame member.

The wall can be stationary with a fixed supporting system or it can be a movable wall with a track and guiding means for guiding the wall along the track. The track can be any conventional type of track, although it is preferred that the track and guiding means to a channel member having a C-shaped cross-section, and having lips extending into the gap of the C on both sides of the channel member. The channel member may have the gap turned upward and have a gliding member on the upper inside of the channel resting against the lips of the channel and pressed upward to engage the lips by a spring or some other such device useful in forcing the member upward. In this case, the supporting channel may be located between the horizontal portion on the hanger and the top of the panel frame when space requirements provide for this type of approach. On the other hand, the channel member may be facing downward and the gliding means may rest in the channel on the lips and be held in place by a spring or some other such device in which case the channel is supported above the hanger and the glide means is attached to the hanger with the hanger supporting the panels. In either of the embodiments hereinbefore described utilizing a channel shaped track, the hanger can be of any of the configurations hereinbefore mentioned to provide for the desired support and connection of the panels as necessary.

Additionally, this invention includes a conventional track, with a roller in the track and with the roller riding along the bottom portion of an upturned channel track member or riding along lips of a channel member as described before, and with the hanger attached to the conventional roller means in order that the panels may move along the track. One method of attaching the hanger to the roller is to have the roller have a depending plate and to have a clip attached to the top of the hanger with the clip having horizontal end portions attached to the top of the hanger and also having a curved upward center portion attached to the depending plate depending from the roller. One preferred embodiment of this attachment is to have the upturned portion of the clip provided with a slot, have the depending plate from the rollers provided with a hole, and have a pin connect the plate within the slot.

Still another embodiment of this invention is the embodiment wherein an upturned channel member is attached to the top portion of the frame of the sound absorption panel, and a glide member is pressed against the upper lips of the upturned channel portion by a conventional spring or the like. The glide means is then connected to a roller on a track of the type hereinbefore described and this connection may be by conventional methods including the slot and pin connection clip as hereinbefore described.

The invention is useful for providing a horizontally movable sound absorption wall utilizing smaller sound absorption panels. The sound absorption panels, useful in this invention, can be any one of a number of designs, but a few requirements are necessary for incorporation within the invention. When the hanger of the invention is used merely for supporting a single sound absorbing panel, the panel can be of the type that has a sound absorbing material supported by a frame extending around its outer edge with the frame having at least one depending lip to be engaged by the hanger for support. If the hanger has the design of only one vertically depending connection portion, then the sound absorbing panel need only have one depending lip depending on the face of the frame. If the hanger is of the type that has two opposing vertically depending portions, then the frame must have depending lip portions depending from both sides of the top of the frame. In these embodiments, the preferable frame design is a frame having a U-shaped cross-section. The top of the frame supports the remainder of the frame by having vertical frame members, and when it is desirable to use the hanger of this invention for connection of two abutting panels, the frame members should be such as to provide on the face of the frame, an area which can be pressed together by the hanger. When both sides of abutting panels are to be connected by a hanger having two vertically depending portions, both sides of the panel should have a similar construction with respect to the frame. The most economical design for accomplishing each of these results is to have a sound absorption panel comprising a sound absorbing material supported by a frame extending around the outer edge of the sound absorbing material, and with said frame having a U-shaped cross-section. This enables the entire frame to be made out of one design of material.

While it is only necessary that the sound absorbing panel have a sound absorbing material supported by a frame of the type and description hereinbefore discussed, it has been found that one particularly acceptable type of sound absorbing panel is a sound absorbing panel having a sound absorbing material completely enclosed in a heat shrunk plastic material with the enclosed sound absorbing material then supported by the frame. In each instance, the sound absorbing material may be of any type necessary to accomplish the required sound absorption results, but it has been found to be particularly acceptable to use mineral fiber or glass fiber, having a density of from four to six pounds per cubic foot. In the preferred embodiment, the sound absorbing material may be coated with any conventional heat shrinkable plastic film, examples of which are polyvinyl chloride films, polypropylene films polyethylene films, and the like. If desired, for additional support and protection, the enclosed sound absorbing material may, as desired, have on one or both faces, a perforated facing material such as a perforated metal and may also, if desired, have on the face opposing the source of the absorbed sound, a solid facing material for additional support.

Still other objects will readily present themselves to one skilled in the art upon reference to the following specification, the drawings, and the claims.

BRIEF DESCRIPTION OF THE DRAWING

This invention may be more fully described, but is not limited, by the attached drawings wherein.

DESCRIPTION OF THE PREFERRED EMBODIMENTS

Figure 1:
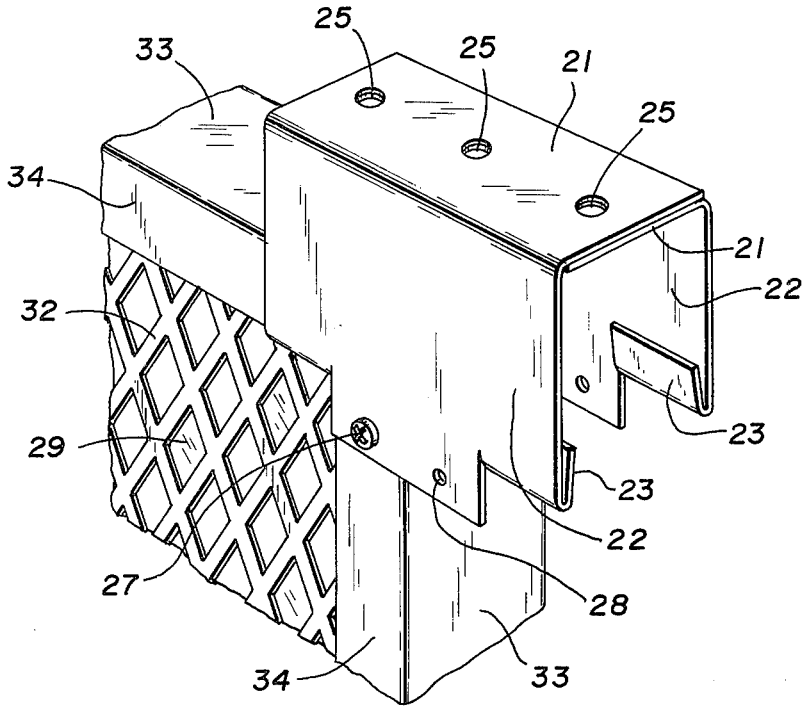
FIG. 1 is a perspective view of one embodiment of the hanger of this invention, illustrating two hangers placed together and useful in both connecting and supporting sound absorption panels.
Figure 2:
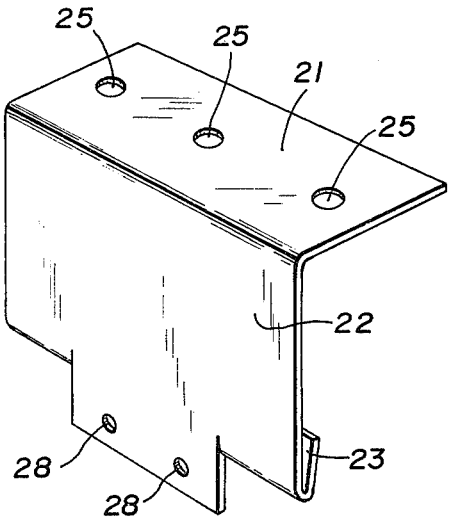
FIG. 2 is a perspective view of one of the hangers shown in FIG. 1.
Figure 3:
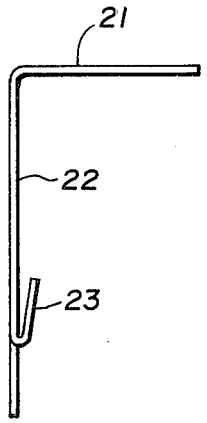
FIG. 3 is an end view of the hanger shown in FIG. 2.
Figure 5:
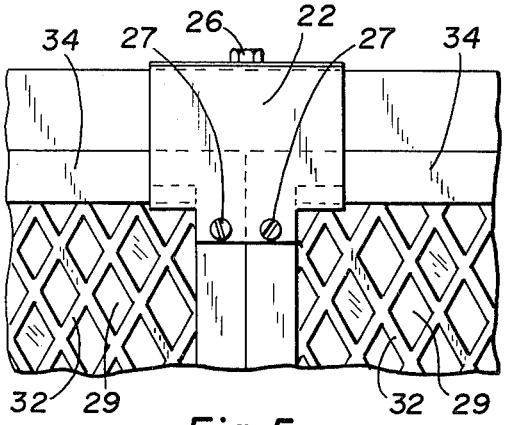
FIG. 5 is a front view of the embodiment shown in FIG. 4 and showing two sound absorption panel connected together by a hanger.
Figure 6:
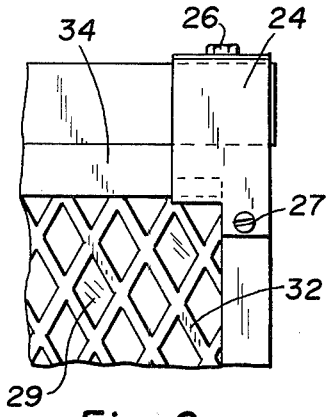
FIG. 6 is a front view of the embodiment shown in FIG. 4 and illustrating a hanger supporting the sound absorption panel at the end of the panel.
Figure 8:
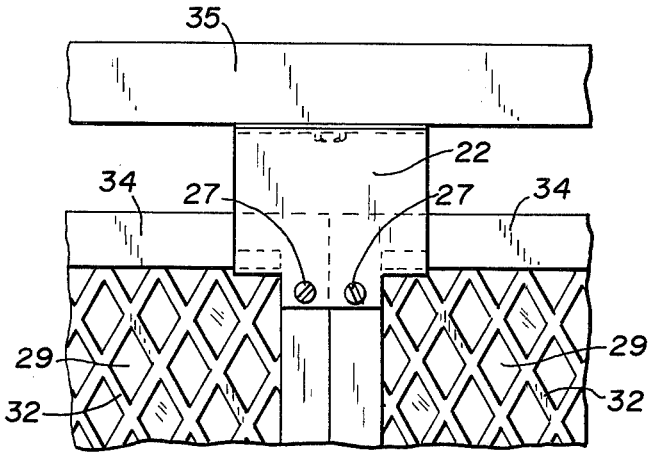
FIG. 8 is a front view of the embodiment shown in FIG. 7.
Figure 10:
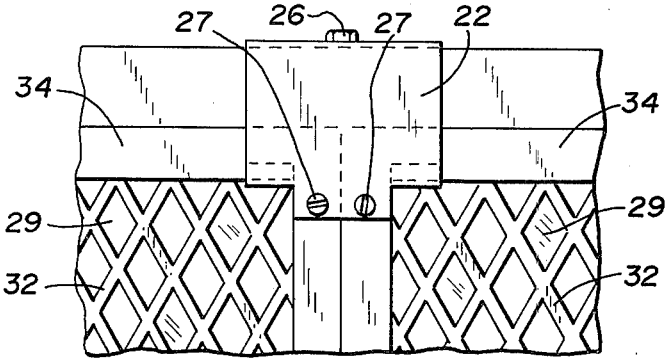
FIG. 10 is a front view of the embodiment shown in FIG. 9.

This invention may be more fully described, but is not to be limited, by reference to the attached drawings and the discussed preferred embodiments wherein referring to FIG. 1 through FIG. 3, a hanger is shown having a horizontal portion 21 and having depending perpendicularly vertically downward from an edge thereof a vertically depending connection portion 22 having as a support portion 23 an upwardly and inwardly formed portion which, in this embodiment, is shown as two support portions on opposing edges of the hanger. In FIG. 6 the hanger has only one support portion formed upward from the vertically depending connection portion 24. It must be understood that the number and spacing of the support portions is to be designed to be sufficient to accomplish the desired results, and two support portions are required where, as is illustrated in FIG. 5, FIG. 8, and FIG. 10, the hanger is additionally utilized for attaching together abutting sound absorption panels. If both sides of a sound absorption panel are to be supported by the hanger, the hanger can consist of two of the previously discussed hangers with their horizontal portions placed together, or, the horizontal portions may be one piece with two vertically depending connection portions. The hanger may be attached to the supporting devices by any conventional means, and for this purpose, holes 25 are shown in the horizontal portion of the hanger with attachment to the supporting surfaces being accomplished by screws 26. Likewise, the vertically depending connection portion may be rigidly attached to the frame of the sound aborbing panel by any conventional methods, such as screws 27 passing through holes 28 in the vertically depending connection portion and thereafter attaching to the frame.

Figure 4:
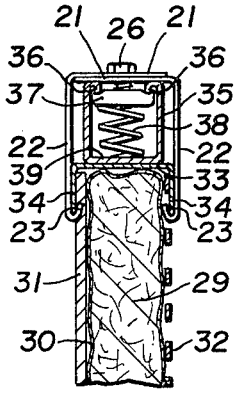
FIG. 4 is a cross-sectional end view of a sound absorption wall system in accordance with this invention.

The sound absorbing panel illustrated has a sound absorbing material 29, of the type hereinbefore discussed, which may be enclosed in a heat shrunk plastic material 30 shown in FIG. 4, if desired, and as hereinbefore discussed. Although not required, the panel may have additional support means such as the illustrated solid facing 31 and the perforated facing 32. The sound absorbing panel has a frame 33 which has one or more depending lip portions 34 with the preferred embodiment being the illustrated frame having a U-shaped cross-section.

Referring now to FIG. 4, a support is provided consisting of a channel member 35 having a C-shaped cross-section and having lips 36 extending into both sides of the gap of the C. Support means are provided by support member 37 which is maintained against the lips by conventional methods such as spring 38. In FIG. 4, the back 39 of the channel member contacts the top of the panel since the channel is disposed between the top of the hanger and the top of the panel. If the support means are loosely held in the channel, the panels can move, but if restricted movement is preferred, the support means can be firmly secured by bolt 26 and can actually be a nut attached to the bolt with the nut held in place during attachment by spring 38.

Figure 7:
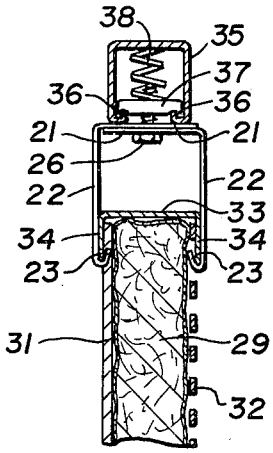
FIG. 7 is a cross-sectional end view of another embodiment of a sound absorption system in accordance with this invention.

Referring now to FIG. 7 and FIG. 8, the channel member 35 has its opening downward and support member 37 rests on lips 36 and is appropriately held thereto by spring 38.

Figure 9:
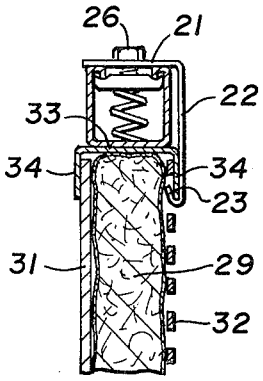
FIG. 9 is a cross-sectional end view of still another sound absorption system in accordance with this invention.

Referring now to FIG. 9, the same embodiment is illustrated in FIG. 4 is shown, with the same type of channel arrangement but with the hanger having only one vertically depending connecting portion.

Figure 11:
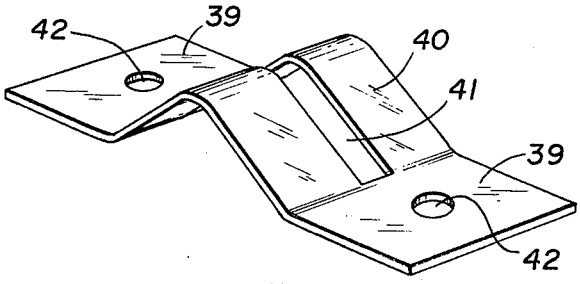
FIG. 11 is a perspective view of a connection clip useful in supporting the wall panels in the sound absorption system of this invention.

Referring now to FIG. 11, a connection clip is shown having horizontal attachment portions 39 with a raised middle portion 40 having a slot 41 therein. The connection clip is useful for attachment in the system by any conventional means, although it is preferred to make connection through holes 42 by bolts 43, shown in FIG. 12 through FIG. 15.

Figure 12:
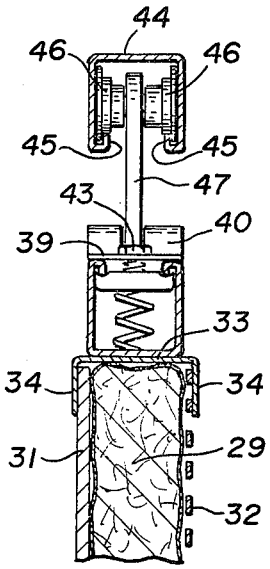
FIG. 12 is a cross-sectional end view of still another embodiment of the sound absorption system of this invention.
Figure 13:
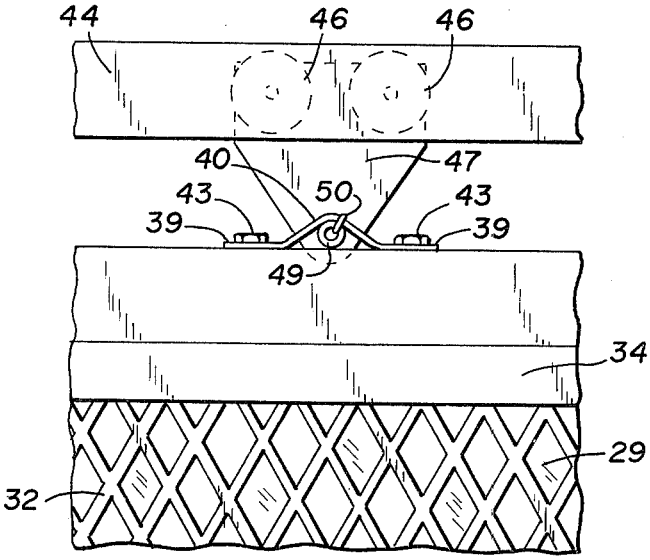
FIG. 13 is a front view of the embodiment shown in FIG. 12.
Figure 14:
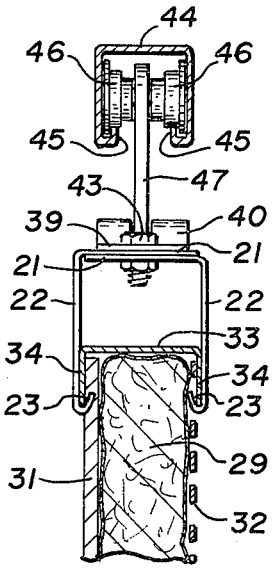
FIG. 14 is a cross-sectional end view of yet another embodiment of the sound absorption system of this invention; and, FIG. 15 is a front view of the embodiments shown in FIG. 14.
Figure 15:
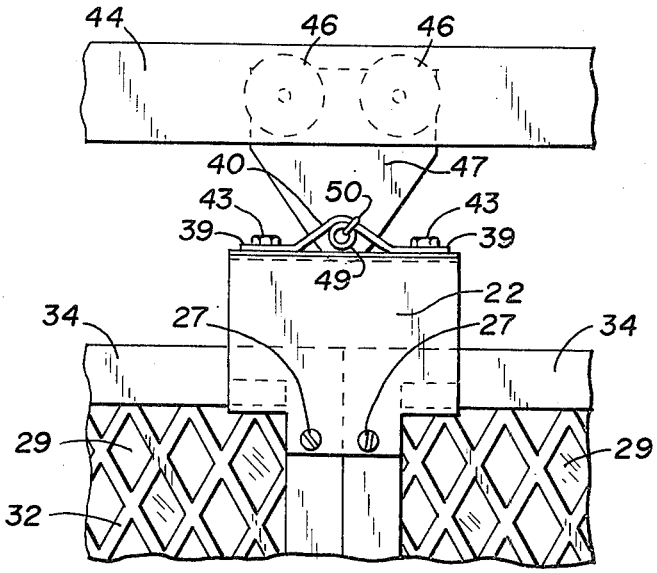

Referring now to FIG. 12 and FIG. 13, the track and guiding means are shown as a channel member 44 in a C-shaped cross-section having lips 45 extending into the gap of the C with rollers 46 riding on the lips. The rollers are attached to a connecting plate 47, which is then attached to the connection clip by conventional means such as the illustrated connection plate having a hole at its lower portion and a rod 49 extending through the hole, with the clip resting thereon and being locked in the hole by pin 50.

While only several forms and embodiments of the invention have been shown and described, other forms and embodiments within the spirit and scope of the invention will become apparent to those skilled in the art. Therefore, the forms and embodiments shown in the drawings are to be considered as merely setting forth the invention for illustrative purposes are not intended to limit the scope of the invention herein described and shown.

It may thus be seen that this invention provides a totally new concept in providing horizontally movable sound absorption wall systems, making use of new hanger design and system arrangement. This invention, therefore, provides a significant advance in designs for sound absorption systems for industrial use.

Having fully described this new and unique invention, the following is claimed:

1. A horizontally movable sound absorption wall comprising one or more sound absorption panels supported by a top frame member; a hanger attached to the top frame member; a supported track; guiding means for guiding movement along the track; and connecting means for attaching the hanger and the guiding means to enable the panels to be moved in a path along the track; wherein the panel frame member has one or more depending lip portions; and wherein the hanger has a horizontal portion, one or more vertically depending connection portions depending vertically downward from the horizontal portion with said vertically depending connection portions having one or more support portions comprising inwardly and upwardly formed portions of the connection portion.

2. A horizontally movable sound absorption wall as in claim 1 wherein the support portions on at least one of the connection portions are spaced apart a distance sufficient to hold together two adjacent abutting panels both of which are supported by said hanger.

3. A horizontally movable sound absorption wall as in claim 2 wherein the hanger has two opposing vertically depending connection portions depending downward from opposing sides of the horizontal portion for connecting and supporting both sides of the top frame member of the panels.

4. A horizontally movable sound absorption wall as in claim 1 wherein the hanger has opposing vertically depending connection portions for supporting both sides of the top frame member of the panel.

5. A horizontally movable sound absorption wall as in claim 1 wherein the supported track and guiding means include a channel having a C-shaped cross-section and having lips extending into both sides of the gap of the C; gliding means for directing movement in the channel; and holding means for holding the gliding means in the channel.

6. A horizontally movable sound absorption wall as in claim 5 wherein the gap of the C of the channel faces upward and the channel is between the horizontal portion of the hanger and the top frame member on the panels.

7. A horizontally movable sound absorption wall as in claim 5 wherein the gap of the C of the channel faces downward and the hanger is attached to the gliding means 8. A horizontally movable sound absorption wall as in claim 1 wherein the supported track and guiding means includes at least one roller and means for connecting the hanger to the roller.

9. A horizontally movable sound absorption wall as in claim 8 wherein the means for connecting the roller to the hanger includes a roller plate depending from the roller; a connection clip having horizontal end protions attached to the hanger, and having an upwardly curved mid-portion; and means for attaching the roller plate to the upwardly turned middle portion of the connection clip.

10. A horizontally movable sound absorption wall as in claim 1 wherein the panels include a sound absorbing material completely enclosed in a heat shrunk plastic material and supported by the frame member extending about the outer edge of the enclosed sound absorbing material.

11. A horizontally movable sound absorption wall as in claim 20 wherein the frame has a U-shaped cross-section.

12. A horizontally movable sound absorption wall as in claim 1 wherein the panels include a sound absorbing material completely enclosed in a heat shrunk plastic material and supported by the frame member extending about the outer edge of the enclosed sound absorbing material and wherein the frame has a U-shaped cross-section.

13. A sound absorption wall comprising one or more sound absorption panels supported by top frame members having one or more depending lip portions; and a supported hanger supporting the frame members by engaging one or more of the depending lip portions, said hanger having a top portion with one or more depending connection portions, and said depending connection portions having one or more support portions for engaging the depending lip portions of the frame members, said support portions comprising members formed inwardly and upwardly toward the top portion; and wherein the hanger has two support portions spaced apart a distance sufficient to hold together two panels members with abutting edges.

* * * * *

UNITED STATES PATENT OFFICE

CERTIFICATE OF CORRECTION

Patent No. 4,031,664 Dated June 28, 1977

Inventor(s) Alan C. Wendt

It is certified that error appears in the above-identified patent and that said Letters Patent are hereby corrected as shown below:

In Claim 11 delete "20" and insert --10--.

Column 1, line 22 after order, insert --to enable--.

Signed and Sealed this

*Sixth* Day of *December 1977*

[SEAL]

*Attest:*

RUTH C. MASON
*Attesting Officer*

LUTRELLE F. PARKER
*Acting Commissioner of Patents and Trademarks*